United States Patent [19]

Durand

[11] Patent Number: 4,566,259

[45] Date of Patent: Jan. 28, 1986

[54] METHOD AND APPARATUS FOR THE MANUFACTURE OF FANCY YARNS

[75] Inventor: Marc Durand, Decines, France

[73] Assignee: Chavanoz S.A., Pont-de-Cheruy, France

[21] Appl. No.: 577,803

[22] Filed: Feb. 7, 1984

[30] Foreign Application Priority Data

Feb. 10, 1983 [FR] France ..... 83 02288

[51] Int. Cl.[4] ..... D02G 3/34; D02G 3/36; D02G 3/38

[52] U.S. Cl. ..... 57/6; 57/12; 57/90; 57/91; 57/207; 57/209

[58] Field of Search ..... 57/6, 12, 207, 206, 57/90, 91, 208, 209

[56] References Cited

U.S. PATENT DOCUMENTS

| | | | |
|---|---|---|---|
| 3,938,313 | 2/1976 | Marzocchi | 57/207 |
| 4,010,601 | 3/1977 | Anahara et al. | 57/6 |
| 4,124,973 | 11/1978 | Hense et al. | 57/207 |
| 4,250,701 | 2/1981 | Schwartz et al. | 57/207 X |

*Primary Examiner*—John Petrakes

*Attorney, Agent, or Firm*—Sherman and Shalloway

[57] ABSTRACT

A method and apparatus for producing a fancy yarn, in which a core and effect yarn 5 are fed along a path to a false twist device 6 and a binding yarn 4 is fed via a rotating component 1 adjacent the path, the component rotating about an axis transverse to the path, and having a yarn guiding portion 3 radially spaced from the axis, whereby the binding yarn is caused to perform a reciprocating, oscillating motion with respect to the core and effect yarns.

3 Claims, 4 Drawing Figures

METHOD AND APPARATUS FOR THE MANUFACTURE OF FANCY YARNS

The invention relates to a method and apparatus for the manufacture of fancy yarns, particularly yarns having protuberances over their lengths, such as knops, slubs or loops.

These yarns are generally produced by doubling at least two yarns one of which, called the core yarn, is covered with at least one second yarn, called the effect yarn, which is over-fed regularly or irregularly relative to the core yarn so as to produce the desired effect, an effect which may be fixed, if appropriate, by means of a third yarn, called a binding yarn.

To retain the shape of the effect and to permit the use of the fancy yarn in subsequent operations of conversion in weaving or knitting, it is necessary that the core and effect yarns do not slide relative to each other, and hence the importance of the binding yarn; the latter is deposited on the core yarn in general at right angles to the latter with an amplitude of reciprocating oscillation of a fixed or variable length. The oscillation is frequently produced by a guide through which the effect yarn passes, with a rod connecting the guide to a driving device. However, the known reciprocating devices such as that described above are bulky, are limited in speed of oscillation and can produce effects which are sometimes maladjusted.

According to the present invention there is provided an apparatus for use in the production of a fancy yarn, said apparatus comprising means for feeding at least one yarn along a path, a rotating component positioned adjacent said path and rotatable about an axis which is transverse to said path, a yarn guiding portion on said rotating component which is spaced from said axis and means to feed a further yarn to said yarn guiding portion, whereby said further yarn is caused to perform a reciprocating, oscillating motion with respect to said at least one yarn.

Such an apparatus permits the use of higher speeds, whilst remedying the above disadvantage. The rotating component can consist of a hollow shaft and a radial disc located at one end of said hollow shaft, adjacent said path and wherein an oblique passage is formed between the hollow interior of said shaft and a point on said disc spaced from the axis of the shaft, whereby said further yarn may be guided through the hollow interior of said shaft and through said passage to said point which thus forms said yarn guiding portion.

This rotating component can also comprise a shaft formed at one end adjacent said path with a U-shaped portion, whereby when said further yarn is passed over said rotatory U-shaped portion in a direction transverse to said path and transverse to the axis of rotation of said shaft, it is caused to perform said reciprocating oscillating motion with respect to said at least one yarn.

According to another aspect of the invention there is provided a method of producing a fancy yarn, said method comprising the steps of feeding a core yarn along a path, overfeeding an effect yarn along said path, passing said core and effect yarns through a false twist device, providing a rotating component at a position adjacent said path and upstream of said false twist device and rotating the component about an axis which is transverse to said path, said rotating component having a yarn guiding portion which is spaced from said axis and feeding a binding yarn to said rotating component and over said yarn guiding portion, whereby said binding yarn is caused to perform a reciprocating, oscillating motion with respect to said core and effect yarns.

In order that the present invention may more readily be understood, the following description is given, merely by way of example, reference being made to the accompanying drawings, in which.

Figure 1:
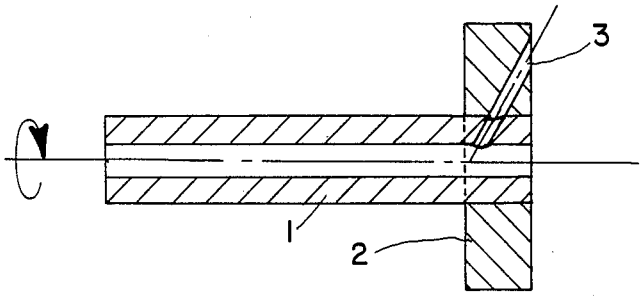
FIG. 1 is a cross sectional side elevation of one embodiment of rotating component of apparatus according to the invention.

In FIG. 1 there is shown a hollow shaft 1 at the end of which is fixed a disc 2 through which is formed an oblique passage 3 opening into the interior of the hollow shaft and to the exterior of the disc 2; this shaft may be rotated about its axis by a known means which are not shown.

Figure 2:
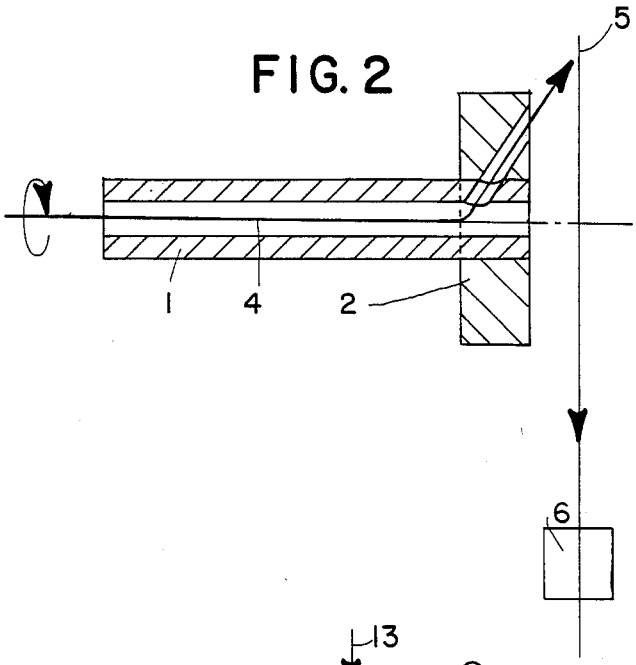
FIG. 2 is a view, similar to FIG. 1, of the apparatus showing it in use in producing a fancy yarn.
Figure 3:
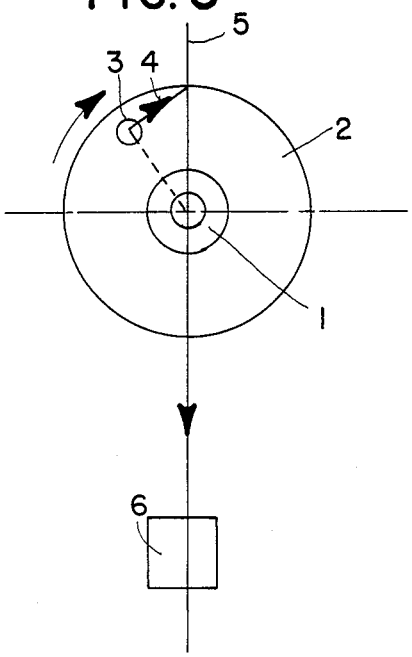
FIG. 3 is an end elevation of the apparatus of FIG. 2.

FIGS. 2 and 3 show, in a side view and a front view, the rotating device as it appears in operation, showing a binding yarn 4 passing through the hollow shaft 1 and through the passage 3, this yarn coming into contact with a yarn 5 comprising a core yarn and an effect yarn. The yarn 5 moves along a path to a false-twist device 6.

When the unit is put into operation, the rotating component 1, 2 rotates depositing the binding yarn 4 on the yarn 5 which has been subjected to a false-twist by the device 6, the axis of the hollow shaft 1 being perpendicular to the path of the yarn 5; the motion of the binding yarn 4 is a reciproacting motion relative to the yarn 5. The effects obtained are the same as with the devices known previously, the amplitude and frequency of oscillation being a function of the speed of rotation of the disc.

Figure 4:
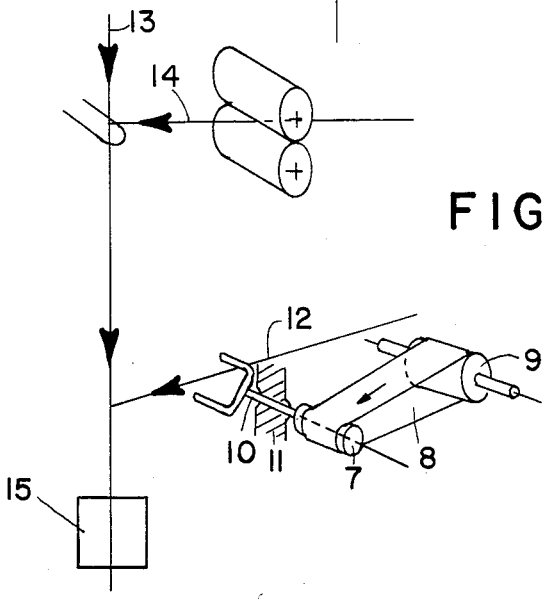
FIG. 4 is a perspective view of a further form of apparatus according to the invention.

In the construction of FIG. 4 a shaft 7 is rotated, for example by a belt 8 driven by a roller 9 mounted on a shaft caused to rotate by a means which is not shown. At one end of the shaft 7, passing through a bearing 11, is a U-shaped rod 10 forming an exterior of the shaft, the exterior being fixed by the base of the U, the outsides of the arms of the U (or prongs of this type of fork) acting on a binding yarn 12. The yarn 12 joins a core yarn 13 and an effect yarn 14, the whole assembly next passing into a false-twist device 15.

In operation, through the rotation of the shaft 7, the two arms of the U rotate and act alternately on the binding yarn 12 imparting to the latter a motion of reciprocating oscillation relative to the core yarn 13 and effect yarn 14, the speed of deposition of the binding yarn 12 being greater than the speed of the core and effect yarns 13, 14. It is possible, or course, to have several rotating components.

In both cases, the simple means of false-twisting, without heating to fix the effects thermally, is employed merely to make possible an alternating Z and S twist.

The fancy yarns which are obtained are of any kind; in particular, it is possible with the means of binding to produce fancy yarns which can be employed as warp yarns in weaving without the need for a sizing operation.

The fancy yarn obtained can be employed in any traditional textile application.

The following example illustrates the present application without restricting it.

EXAMPLE

Using the device such as illustrated in FIGS. 1 to 3, a fancy yarn was produced under the following conditions:

core yarn consisting of an FTF polyethylene terephthalate filament yarn of 167 dtex/30 ends, an effect yarn consisting of an acetate filament yarn of 167 dtex/26 ends, a binding yarn consisting of an FT poly-hexamethylene diamine filament yarn of 33 dtex/10 ends,

| | |
|---|---|
| the yarn obtained is of: | 650 dtex |
| reception speed: | 40 m/min |
| delivery speed: | 92 m/min |
| speed of rotation of the shaft: | 3,000 rpm. |

What is claimed is:

1. Apparatus for use in the production of a fancy yarn, said apparatus comprising means for feeding at least one yarn along a path, a rotating component positioned adjacent said path and rotatable about an axis which is trnsverse to said path, a yarn guiding portion on said rotating component which is spaced from said axis and means to feed a further yarn to said yarn guiding portion, whereby said further yarn is caused to perform a reciprocating, oscillating motion with respect to said at least one yarn, wherein said rotating component comprises a hollow shaft and a radial disc located at one end of said hollow shaft, adjacent said path, and wherein an oblique passage is formed between the hollow interior of said shaft and a point on said disc spaced from the axis of the shaft, whereby said further yarn may be guided through the hollow interior of said shaft and through said passage to said point which thus forms said yarn guiding portion.

2. An apparatus according to claim 1 having a false twist device position in the path of said at least one yarn beyond the point of contact with said further yarn, and applying a twist to said one yarn that, when released, will cause said one yarn and said further yarn to intertwine.

3. A method for producing a slub fancy yarn, said method comprising the steps of feeding a core yarn along a path, feeding an effect yarn through a way comprising a hollow shaft of a rotating component and an oblique passage in a radial disc located at one end of said rotating component near the path of said core yarn and on an axis transverse to said path, and rotating said component and said radial disc, the rotation causing the effect yarn to perform a reciprocating, oscillating motion along the path of the core yarn in order to produce slubs periodically along the said core yarn.

* * * * *

UNITED STATES PATENT AND TRADEMARK OFFICE

CERTIFICATE OF CORRECTION

PATENT NO. : 4,566,259

DATED : January 28, 1986

INVENTOR(S) : MARC DURAND

It is certified that error appears in the above-identified patent and that said Letters Patent is hereby corrected as shown below:

IN THE CLAIMS

Claim 1, line 5, (column 3, line 24),
delete "trnsverse", insert --transverse--.

Claim 2, line 2, (column 4, line 11),
delete "position", insert --positioned--.

Signed and Sealed this

*Twenty-second* Day of *April 1986*

[SEAL]

*Attest:*

DONALD J. QUIGG

*Attesting Officer*

*Commissioner of Patents and Trademarks*